US007264708B2

(12) United States Patent
Whitmore et al.

(10) Patent No.: US 7,264,708 B2
(45) Date of Patent: Sep. 4, 2007

(54) CATHODIC PROTECTION SYSTEM USING IMPRESSED CURRENT AND GALVANIC ACTION

(75) Inventors: David Whitmore, Winnipeg (CA); John Christopher Ball, Tampa, FL (US)

(73) Assignee: Vector Corrosion Technologies Ltd., Winnipeg, Manitoba (CA)

( * ) Notice: Subject to any disclaimer, the term of this patent is extended or adjusted under 35 U.S.C. 154(b) by 249 days.

(21) Appl. No.: 10/996,810

(22) Filed: Nov. 26, 2004

(65) Prior Publication Data

US 2006/0108235 A1 May 25, 2006

(51) Int. Cl.
*C23F 13/20* (2006.01)

(52) U.S. Cl. ..... 205/734; 205/740

(58) Field of Classification Search ..... 205/734, 205/740; 204/196.36, 196.37
See application file for complete search history.

(56) References Cited

U.S. PATENT DOCUMENTS

H000544 H * 11/1988 Castillo et al. ..... 205/734
6,346,188 B1 2/2002 Shuster et al. ..... 205/734

* cited by examiner

*Primary Examiner*—Bruce F. Bell
(74) *Attorney, Agent, or Firm*—Adrian D. Battison; Michael R. Williams; Ryan W. Dupuis

(57) ABSTRACT

Cathodic protection of steel in a building or other concrete or similar structure is provided by locating an anode in a suitable location adjacent to the steel and providing an impressed current from a power supply to the anode. The anode is formed from a material which is more electro-negative than the steel so that in the event that the power supply falls below the galvanic potential therebetween, current flows under galvanic action to replace the impressed current. A diode in the circuit prevents flow of current across the power supply but allows the galvanic current when the power supply fails open circuit. An additional diode can be provided in the event the power supply fails closed circuit to prevent reverse current flow.

16 Claims, 3 Drawing Sheets

CATHODIC PROTECTION SYSTEM USING IMPRESSED CURRENT AND GALVANIC ACTION

This invention relates primarily to a cathodic protection system using impressed current and galvanic action and also relates to an improved impressed current system.

BACKGROUND OF THE INVENTION

U.S. Pat. No. 6,346,188 (Shuster) assigned to ENSER Corporation and issued Feb. 12, 2002 discloses a method for cathodic protection of marine piles in which an anode is located within a jacket surrounding the pile at water level and a battery is mounted on the pile above the water level for providing an impressed current between the anode of the jacket and the steel of the pile.

The anode is preferably formed of titanium or other non-corroding materials which are high on the Noble scale. However the patent mentions that other materials such as zinc can be used but these are disadvantageous since they tend to corrode. The intention is that the battery have a long life and be maintained effectively so that the impressed current remains in place during the life of the marine pile bearing in mind that the salt water in the marine environment is particularly corrosive.

Such impressed current systems can use other types of power supply including common rectifiers which rectify an AC voltage from a suitable source into a required DC voltage for the impressed current between the anode and the steel. It is also known to provide solar panels for charging batteries to be used in a system of this type.

In all cases such impressed current systems require regular maintenance and checking of the status of the power supply to ensure that the power supply does not fail leading to unexpected and unacceptable corrosion of the steel within the structure to be protected. While such maintenance can be carried out and the power supply thus ensured, this is a relatively expensive process.

Alternatively galvanic systems can be used which avoid necessity for any power supply since the voltage between the steel and the anode is provided by selecting a suitable material for the anode which is sufficiently electro-negative to ensure that a current is generated to provide a cathodic protection. The systems have obtained considerable success and are widely used.

SUMMARY OF THE INVENTION

It is one object of the invention to provide an improved method for cathodic protection.

According to one aspect of the invention there is provided a method for cathodic protection comprising:

providing steel material;

providing a covering material such that at least a part of the steel material is at least partly covered by the covering material;

providing at least one anode member which is formed of a material which is more electro-negative than the steel material such that galvanic action will generate an electric potential difference therebetween tending to cause a flow of ions;

arranging the anode member at least partly in contact with the covering material for communication of ions therebetween;

providing a first connection between the at least one anode member and the steel material so that the galvanic potential difference between the anode member and the steel material generated by the galvanic action causes ions to flow through the covering material tending to inhibit corrosion of the steel material while causing corrosion of the anode member;

providing a second connection between the at least one anode member and the steel material including a DC power supply having a supply potential difference greater than the galvanic potential difference between the anode member and the steel material generated by the galvanic action such that the supply potential difference causes ions to flow through the covering material tending to inhibit corrosion of the steel material while causing corrosion of the anode member;

the first and second connections being arranged to prevent communication of current through the first connection across the power supply such that when the DC power supply potential difference exceeds the galvanic potential difference current flows through the second connection;

the first and second connections being arranged to allow communication of current through the first connection such that when the supply potential difference falls below the galvanic potential difference current flows through the first connection;

whereby ions are caused by the power supply to flow to provide cathodic protection to the steel material for as long as the power supply is active and, when the power supply is inactive, ions are caused to continue to flow by the galvanic action to continue to provide cathodic protection to the steel material.

The anode may be any of the more electro-negative materials such as zinc, aluminum, magnesium or alloys thereof.

Preferably the power supply is a battery. However rectifiers generating DC from an AC supply voltage can also be used in some arrangements.

Preferably the battery has a potential greater than 1.5V.

Preferably there is provided a diode in the first connection to prevent communication of current through the first connection across the power supply.

Preferably the first connection bridges output terminals of the power supply.

Preferably there is provided a diode in second connection to prevent flow of current in a reverse direction.

In accordance with one important optional arrangement, the battery is not replaced when expired such that when the battery expires the protection is wholly provided by the galvanic action.

In accordance with one important optional arrangement, the covering material comprises a structural material of a building and the battery is buried in the structural material of the building.

In accordance with one important optional arrangement, the structural material forms a wall and wherein the battery is buried in a cavity in the wall.

In accordance with one important optional arrangement, the covering material comprises a structural material of a building and wherein there is provided a plurality of batteries at plurality of respective locations on the building.

In accordance with one important optional arrangement, the building includes a plurality of steel elements each forming, for example, a lintel of the building and wherein there is provided a separate battery for each lintel.

According to a second aspect of the invention there is provided a method for cathodic protection comprising:

providing steel material;

providing a covering material such that at least a part of the steel material is at least partly covered by the covering material;

providing at least one anode member;

arranging the anode member at least partly in contact with the covering material for communication of ions therebetween;

providing a connection between the at least one anode member and the steel material including a DC power supply having a supply potential difference between the anode member and the steel material such that the supply potential difference causes current to flow in the connection in a direction to cause ions to flow through the covering material tending to inhibit corrosion of the steel material while causing corrosion of the anode member;

and providing a diode in connection to prevent flow of current in a reverse direction.

BRIEF DESCRIPTION OF THE DRAWINGS

One embodiment of the invention will now be described in conjunction with the accompanying drawings in which.

In the drawings like characters of reference indicate corresponding parts in the different figures.

DETAILED DESCRIPTION

Figure 1:
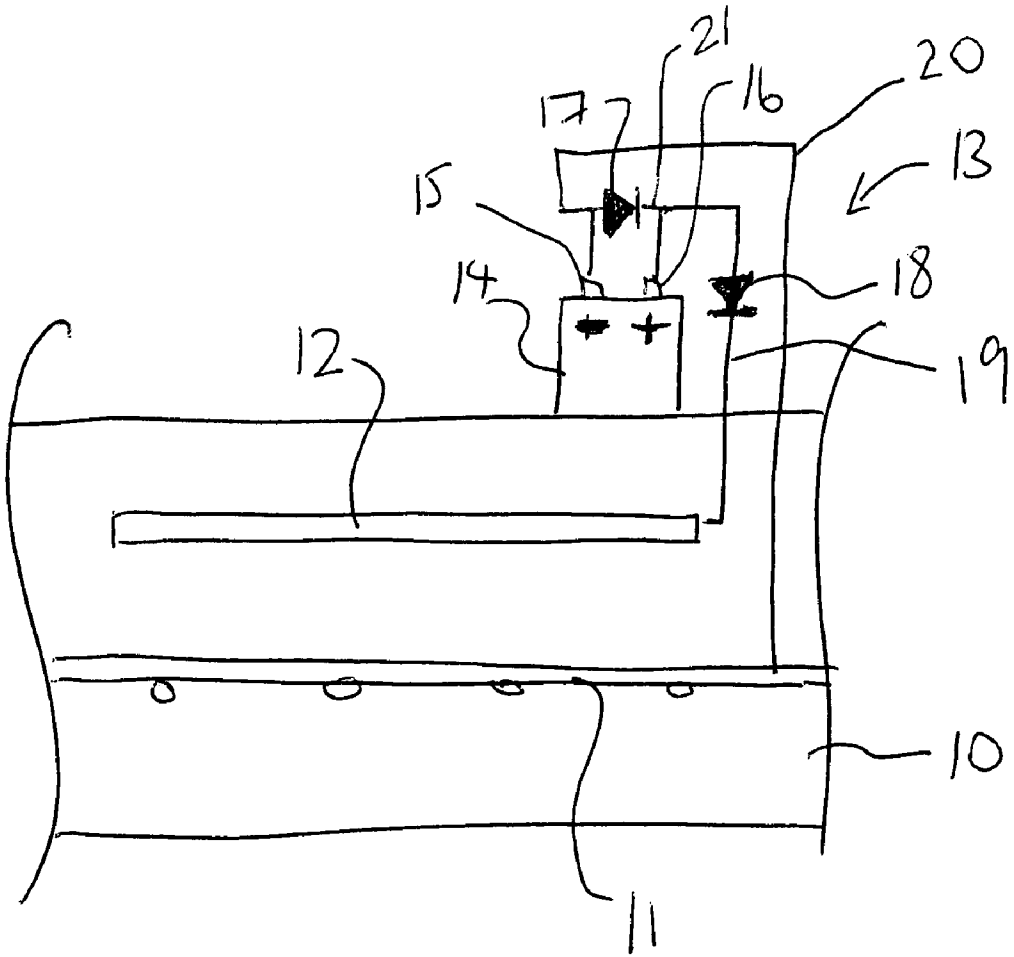
FIG. 1 is a schematic illustration of a cathodic protection method according to the present invention.

In FIG. 1 is shown a covering material 10 within which is embedded steel material 11 and an anode body 12.

The covering material 10 is a suitable material which allows communication of ions through the covering material between the anode body and the steel 11. The covering material is generally concrete but can also include mortar or masonry materials where there is a reinforcing steel structure which requires cathodic protection to prevent or inhibit corrosion. The steel material 11 is illustrated as being a reinforcing bar arrangement but other steel elements can be protected in the manner of the arrangement shown herein including steel structural members such as lintels, supports for exterior hardware or other elements which provide structure to the concrete or other covering material or which provide interconnection between an exterior element and the concrete material.

The anode member 12 is shown as a strip or sheet but can be configured in any suitable arrangement which is arranged to provide communication of ions from the anode body to the steel material.

The anode member may include or be constructed as the arrangement shown in U.S. Pat. No. 6,027,633 issued Feb. 22, 2000; U.S. Pat. No. 6,165,346 issued Dec. 26, 2000; U.S. Pat. No. 6,572,760 issued Jun. 3, 2003 and U.S. Pat. No. 6,793,800 issued Sep. 21, 2004 of the present inventor, and in U.S. Pat. No. 6,022,469 (Page) issued Feb. 8, 2000 and U.S. Pat. No. 6,303,017 (Page) issued Oct. 16, 2001 assigned to Aston Material Sciences and in U.S. Pat. No. 6,193,857 (Davison) issued Feb. 27, 2001 assigned to Foseco International, the disclosures of which are incorporated herein by reference or to which reference should be made for further details as required.

The anode member is preferably formed of zinc or other material which is more electro-negative than the steel so that its presence within the covering material generates a potential difference by way of galvanic action across the anode member and the steel such that the galvanic potential causes transmission of ions between the anode member and the steel material and a current through a conductor system generally indicated at 13 which transmits current between the anode member and the steel.

A power supply 14 is provided which generates a voltage at terminals 15 and 16 of the power supply where the terminal 16 is positive and the terminal 15 is negative.

In the embodiment shown the power supply is formed by a battery which is commonly a zinc air battery well known and commercially available which provides an output voltage of the order of 1.5 volts and has a lifetime of the order of 3 to 5 years. The voltage may drop during current draw in operation from the nominal value to as low as 1.0 volts. Such batteries of this type are commercially available from ENSER Corporation or others. A suitable battery may have a capacity of 1200 ampere hours.

Alternative power supplies maybe used including conventional rectifiers which require an exterior AC supply voltage and which convert the AC supply into a DC voltage at the terminals 15 and 16.

The current supply system generally indicated at 13 further includes a first diode 17 and the second diode 18.

The power supply is connected across the anode member and the steel material by a first connection such that the positive terminal 16 of the battery is attached to the anode member by a first conductor 19 which extends from the positive terminal 16 to the anode member 12. The first connection further includes a second conductor 20 which connects from the negative terminal 15 to the steel material 11. Thus when the battery 14 provides an output voltage greater than the galvanic potential, current flows from the battery through the conductor 19 and returns from the steel through the conductor 20.

In the event that the potential of the battery falls below the galvanic potential, in the situation where the battery has expired or becomes faulty, a second connection is provided across the anode member 12 and the steel material by way of the conductors 19 and 20 together with a further conductor 21 which bridges the terminals 15 and 16. The diode 17 is located in the conductor 21 and is directed so as to prevent current flowing directly from the positive terminal 16 through the conductor 21 to the negative terminal 15. However when the current from the battery fails, the galvanic potential causes current to flow through the conductor 21 in the direction permitted by the diode 17.

The second diode 18 is located either in the conductor 19 or in the conductor 20 and is arranged to prevent reverse current in the first connection.

Thus in the protection system, the power supply 14 provides an initial impressed current system which generates current at a higher level than the galvanic potential for a period defined by the life of the battery. This initial impressed current can be used to cause an initial migration of ions so as to ensure an adequate initial level of protection for the steel material. After this initial level has been achieved, provided the system is properly designed and arranged, the galvanic potential can provide a further level of protection at a reduced current which is sufficient to maintain the migrated ions from returning to the position where corrosion can occur.

When the power supply fails, it normally fails in an open circuit condition so that the conductor 21 is required to allow the galvanic potential to communicate the required current.

However in the event that the power supply fails in a closed circuit condition, the diode 18 is provided in order to prevent reverse current in a direction which would exacerbate the corrosion of the steel material. Thus it is intended that the system should operate over a lifetime of the structure without the necessity for periodic maintenance since the intention is that the battery will operate for a prescribed period and then will fail in a manner which allows the galvanic action to continue.

The selection of the anode body including the amount of sacrificial anode material within the anode body and the further features of design are selected so that the protection is provided over a prescribed lifetime significantly longer than the lifetime of the battery.

The diode 18 is provided to prevent the reverse direction of current flow which would cause corrosion of the steel in preference to the anode. While this is normally not likely to occur when the anode is formed of an electro-negative material, in some design arrangements, the anode may be formed of a material which is more resistant to corrosion and therefore can potentially cause potential corrosion of the steel.

Figure 2:
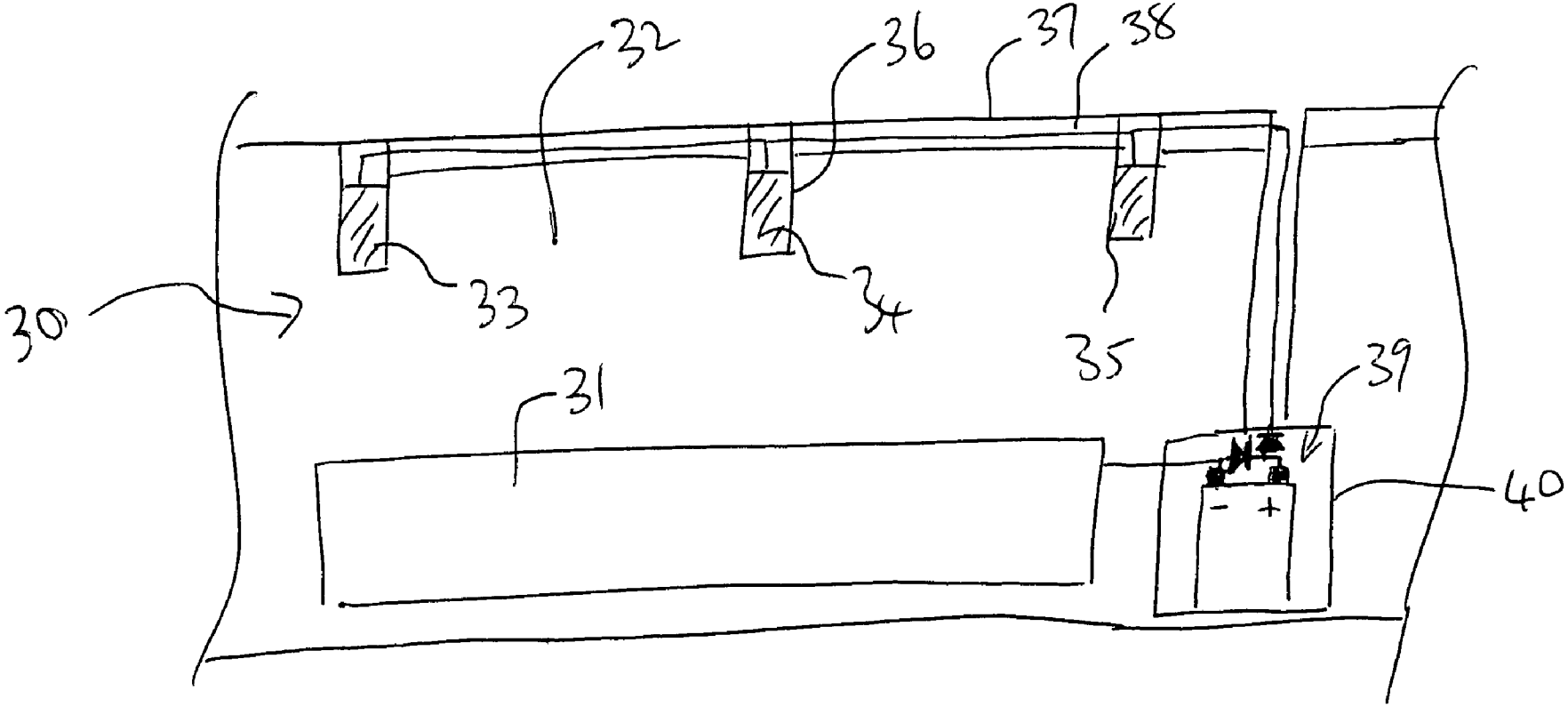
FIG. 2 is a schematic illustration of a second method according to the present invention.

Turning now to FIG. 2, there is shown basically the same arrangement as previously described but used in a modified system for use in a building generally indicated at 30. In the building is provided a lintel 31 formed of steel with the potential for corrosion within the covering material 32 defined in the building. The covering material may be concrete or masonry and commonly will be a series of stones embedded in a mortar material so that the steel is in contact with the stones and the mortar and has the potential for corrosion.

Figure 3:
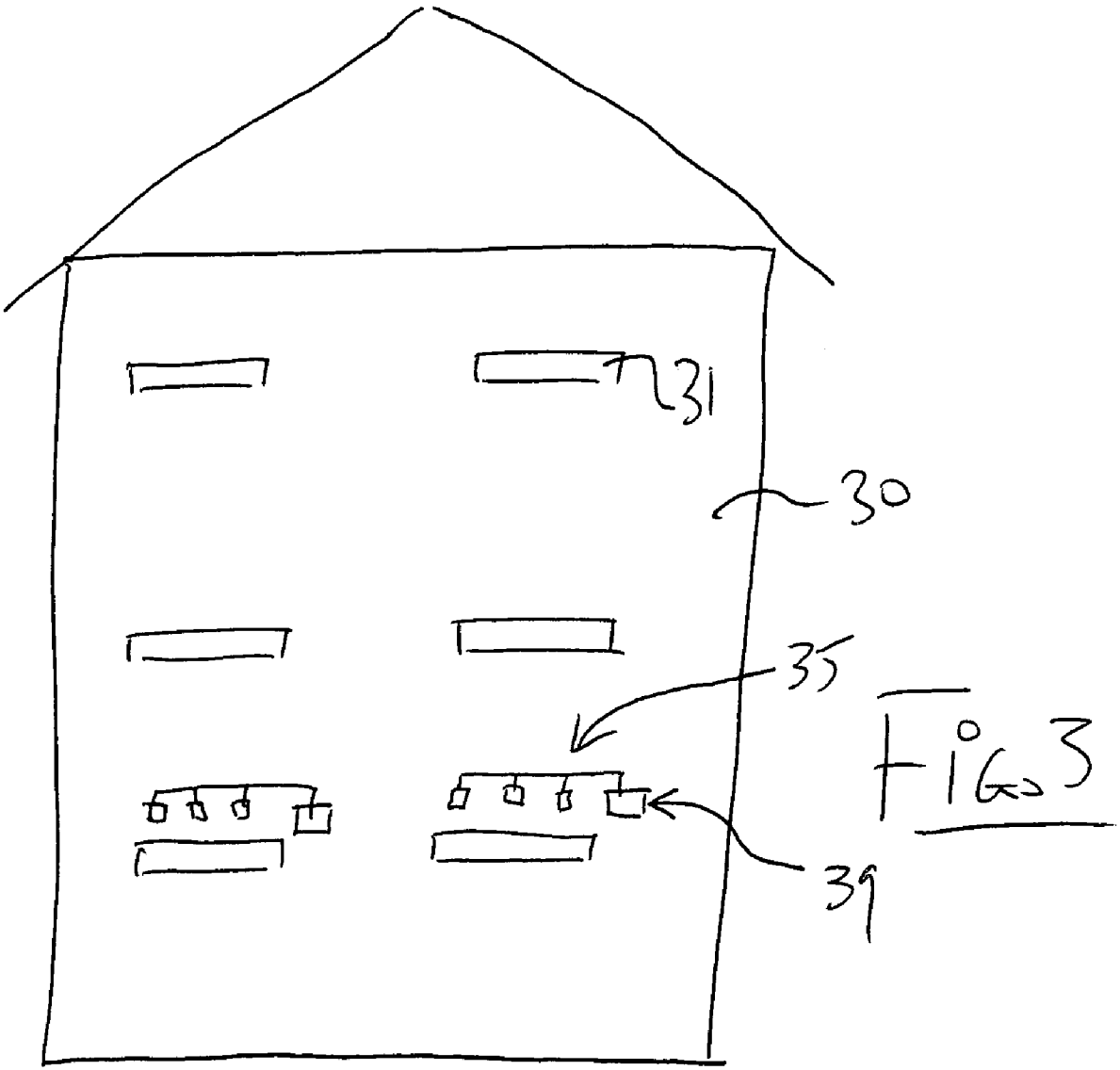
FIG. 3 is a schematic illustration of the components of FIG. 2 installed in a building.

In this embodiment the anode is formed by a series of anode bodies 33, 34 and 35 which are formed as cylindrical elements inserted into drilled holes 36 formed in the structure of the building 30. A channel 37 provides a conduit formed in the wall for a conductor system 38 including a power supply and first and second conduction paths generally indicated at 39 as previously described In FIG. 3 is shown a building schematically indicated at 30 including the lintels 31 and a series of the anode constructions generally indicated at 35 and the power supply systems 39. The power supply system is embedded within a cavity 40 formed in the wall at a suitable location either within a cavity wall construction or within an excavated opening within the building structure. Each lintel has its own power supply 39. Of course the lintel forms only one possibility for steel structure elements within the building which require corrosion protection so that other individual elements may be similarly protected by some individual power supply.

Since various modifications can be made in my invention as herein above described, and many apparently widely different embodiments of same made within the spirit and scope of the claims without department from such spirit and scope, it is intended that all matter contained in the accompanying specification shall be interpreted as illustrative only and not in a limiting sense.

The invention claimed is:

1. A method for cathodic protection of steel material in; a covering material arranged such that at least a part of the steel material is at least partly covered by the covering material; the method comprising:

providing at least one anode member which is formed of a material which is more electro-negative than the steel material such that galvanic action will generate an electric potential difference therebetween tending to cause a flow of ions;

arranging the anode member at least partly in contact with the covering material for communication of ions therebetween;

providing an electrical connection arrangement between the at least one anode member and the steel material so that current can flow through said at least one electrical connection arrangement between the at least one anode member and the steel material so that ions flow through the covering material tending to inhibit corrosion of the steel material;

providing a DC power supply having a supply potential difference greater than the galvanic potential difference between the anode member and the steel material generated by the galvanic action;

connecting the DC power supply into said electrical connection arrangement such that the supply potential difference causes ions to flow through the covering material tending to inhibit corrosion of the steel material for as long as the power supply is active to generate a supply potential difference greater than the galvanic potential difference between the anode member and the steel material generated by the galvanic action;

and said electrical connection arrangement being arranged such that, when the power supply becomes inactive such that the supply potential difference falls below the galvanic potential difference between the anode member and the steel material generated by the galvanic action, current continues to flow through said electrical connection arrangement by the galvanic action to continue to provide cathodic protection to the steel material.

2. The method according to claim 1 wherein the DC power supply is a battery.

3. The method according to claim 2 wherein the battery has a supply potential difference of the order of or greater than 1.5V.

4. The method according to claim 2 wherein the covering material comprises a structural material of a building and wherein the battery is buried in the structural material of the building.

5. The method according to claim 4 wherein the structural material forms a wall and wherein the battery is buried in a cavity in the wall.

6. The method according to claim 4 wherein the covering material comprises a structural material of a building and wherein there is provided a plurality of batteries at plurality of respective locations on the building.

7. The method according to claim 4 wherein the building includes a plurality of steel elements of the building and wherein there is provided a separate battery for each element.

8. The method according to claim 1 wherein the electrical connection arrangement includes a connection which bridges output terminals of the DC power supply and wherein there is provided a diode in the connection to prevent communication of current through the electrical connection arrangement across the DC power supply.

9. The method according to claim 1 wherein there is provided a diode in electrical connection arrangement to prevent flow of current in a reverse direction.

10. A method for cathodic protection of steel material in a covering material arranged such that at least a part of the steel material is at least partly covered by the covering material; the method comprising:

providing at least one anode member which is formed of a material which is more electro-negative than the steel material such that galvanic action will generate an electric potential difference therebetween tending to cause a flow of ions;

arranging the anode member at least partly in contact with the covering material for communication of ions therebetween;

providing an electrical connection arrangement between the at least one anode member and the steel material so that current can flow through said at least one electrical connection arrangement between the at least one anode member and the steel material so that ions flow through the covering material tending to inhibit corrosion of the steel material;

providing a DC power supply having a supply potential difference greater than the galvanic potential difference between the anode member and the steel material generated by the galvanic action;

connecting the DC power supply into said electrical connection arrangement such that the supply potential difference causes current to flow in the electrical connection arrangement in a required direction so that ions flow through the covering material tending to inhibit corrosion of the steel material when the power supply is active and generates a supply potential difference greater than the galvanic potential difference between the anode member and the steel material generated by the galvanic action;

providing in said electrical connection arrangement a connection to allow flow of current across the DC power supply such that, when the DC power supply becomes inactive such that the supply potential difference falls below than the galvanic potential difference between the anode member and the steel material generated by the galvanic action, current continues to flow through said electrical connection arrangement by the galvanic action to continue to provide cathodic protection to the steel material;

and providing in said connection a diode arranged to prevent flow of current across said DC power supply in a direction reverse to said required direction.

11. The method according to claim 10 wherein the DC power supply is a battery.

12. The method according to claim 11 wherein the battery has a potential greater than 1.5V.

13. The method according to claim 10 wherein the covering material comprises a structural material of a building and wherein the power supply comprises a battery which is buried in the structural material of the building.

14. The method according to claim 13 wherein the structural material forms a wall and wherein the battery is buried in a cavity in the wall.

15. The method according to claim 13 wherein the covering material comprises a structural material of a building and wherein there is provided a plurality of batteries at plurality of respective locations on the building.

16. The method according to claim 13 wherein the building includes a plurality of steel elements each forming a lintel of the building and wherein there is provided a separate battery for each lintel.

* * * * *